US006782675B1

(12) United States Patent
Banks et al.

(10) Patent No.: US 6,782,675 B1
(45) Date of Patent: Aug. 31, 2004

(54) SYSTEM AND PROCESS FOR PACKAGING AND DISTRIBUTING BALLOONS

(76) Inventors: Emily M. Banks, 3861 Coastal Hwy., St. Augustine, FL (US) 32084; Christopher Hill, 3861 Coastal Hwy., St. Augustine, FL (US) 32084; Akira Nakamura, 1-4-15, Fukami-Higashi, Yamato-shi, Kanagawa, 242-0012 (JP)

( * ) Notice: Subject to any disclaimer, the term of this patent is extended or adjusted under 35 U.S.C. 154(b) by 0 days.

(21) Appl. No.: 10/455,047

(22) Filed: Jun. 5, 2003

(51) Int. Cl.[7] ..... B65B 55/22

(52) U.S. Cl. ..... 53/431; 53/111 RC; 53/432; 53/512; 53/239; 206/204; 206/205; 206/213.1

(58) Field of Search ..... 53/401, 402, 410, 53/431, 432, 445, 467, 474, 510, 111 RC, 155, 128.1, 238, 239; 206/69, 204, 205, 213.1, 812; 446/220

(56) References Cited

U.S. PATENT DOCUMENTS

| | | | | | |
|---|---|---|---|---|---|
| 1,168,381 | A | * | 1/1916 | Dodge | 206/69 |
| D74,106 | S | | 12/1927 | Gordon | |
| 2,339,283 | A | * | 1/1944 | Mendel | 206/69 |
| 2,365,556 | A | * | 12/1944 | Karg | 206/205 |
| 2,974,782 | A | * | 3/1961 | Walters | 206/69 |
| 3,092,388 | A | * | 6/1963 | Wagenheim | 446/220 |
| 3,136,417 | A | * | 6/1964 | Clinch | 206/205 |
| 4,268,030 | A | | 5/1981 | Richards | |
| 4,305,501 | A | * | 12/1981 | Collette | 446/220 |
| 4,811,847 | A | * | 3/1989 | Reif et al. | 206/213 |
| 4,917,646 | A | | 4/1990 | Kieves | |
| 5,036,985 | A | | 8/1991 | Lovik | |
| 5,108,339 | A | | 4/1992 | Kieves | |
| 5,127,867 | A | | 7/1992 | Lau | |
| 5,169,353 | A | | 12/1992 | Myers | |
| 5,254,026 | A | | 10/1993 | Kaiser | |
| 5,259,805 | A | | 11/1993 | Kieves | |
| 5,338,243 | A | | 8/1994 | Kieves | |
| 5,370,161 | A | * | 12/1994 | Shafer | 141/114 |
| 5,399,122 | A | * | 3/1995 | Slater | 446/220 |
| 5,402,591 | A | | 4/1995 | Lee | |
| 5,471,797 | A | | 12/1995 | Murphy | |
| 5,603,185 | A | | 2/1997 | Murphy | |
| D384,985 | S | | 10/1997 | Cronic | |
| 5,713,777 | A | | 2/1998 | Greenwald | |
| 5,753,156 | A | * | 5/1998 | Shigemori et al. | 264/53 |
| 5,769,685 | A | | 6/1998 | Nakamura et al. | |
| 5,776,291 | A | * | 7/1998 | Lang | 446/220 |
| 5,779,614 | A | * | 7/1998 | Kurtz | 493/436 |
| 5,797,783 | A | * | 8/1998 | Harris | 446/220 |
| 5,819,448 | A | | 10/1998 | Kieves et al. | |
| 5,885,524 | A | * | 3/1999 | Watanabe et al. | 206/204 |
| D414,222 | S | | 9/1999 | Kieves et al. | |
| D415,841 | S | | 10/1999 | Kieves et al. | |
| 6,076,758 | A | | 6/2000 | Kieves et al. | |
| 6,106,775 | A | * | 8/2000 | Fuller | 422/40 |
| 6,152,530 | A | | 11/2000 | Hsu et al. | |
| 6,279,737 | B1 | * | 8/2001 | Long et al. | 206/205 |
| 6,375,000 | B1 | * | 4/2002 | Weder et al. | 206/204 |

* cited by examiner

*Primary Examiner*—Stephen F. Gerrity
(74) *Attorney, Agent, or Firm*—Knoble Yoshida & Dunleavy, LLC

(57) ABSTRACT

A method of packaging a plastic balloon preferably includes steps of sealing the plastic balloon within a substantially airtight package and maintaining the environment within the package in such a condition as to maintain the plastic balloon in a hydrated state that will optimize the performance characteristics of the plastic balloon when it is inflated. Antifungal and antibacterial agents are preferably also provided within the package to inhibit the growth of mold and bacteria.

31 Claims, 1 Drawing Sheet

SYSTEM AND PROCESS FOR PACKAGING AND DISTRIBUTING BALLOONS

BACKGROUND OF THE INVENTION

1. Field of the Invention

This invention relates generally to non-latex, plastic balloons and more particularly to a system and process for packaging and distributing such plastic balloons that is expected to materially enhance the performance characteristics of the balloon upon inflation.

2. Description of the Related Technology

The popularity of non-latex, plastic balloons has grown tremendously in recent years. This type of balloon typically includes two flexible plastic sheets that are heat sealed together in one of many possible different configurations (e.g., a circle or heart shape). One or both of the sheets may be decorated or metallized to provide an aesthetically pleasing balloon. One significant advantage of plastic balloons is their relative impermeability towards air or helium. However, non-latex balloons tend to show wrinkles at their heat-seal lines once they are inflated to a normally recommended inflating pressure.

The present inventors have known that the operating performance of plastic balloons tends to be optimized when the plastic balloons are kept in a hydrated state. Specifically, a hydrated plastic balloon tends to be more soft and pliable than a plastic balloon that is not hydrated; it will show fewer wrinkles when inflated and will be less likely to fail under pressure. To that end, the inventors have been recommending to customers that balloons should preferably be stored in a moist environment such as a humidor. Doing so, however, presents a logistical problem to many distributors and retailers. Moreover, the plastic material will tend to lose its hydration after it has been removed from the humidor for further distribution or sale to the end consumer.

A need exists for an improved system and process for ensuring that plastic balloons are kept within their optimal hydrated state from the time of their manufacture until they are about to be used by a consumer.

SUMMARY OF THE INVENTION

Accordingly, it is an object of the invention to provide an improved system and process for ensuring that plastic balloons are kept within their optimal hydrated state from the time of their manufacture until they are about to be used by a consumer.

In order to achieve the above and other objects of the invention, a method of packaging a plastic balloon according to a first aspect of the invention includes steps of providing a plastic balloon; inserting the plastic balloon into a package; and establishing an environment within the package that is sufficient to maintain the balloon in a hydrated state.

According to a second aspect of the invention, a system for packaging a plastic balloon includes a package; a plastic balloon contained within the package; and hydration structure for establishing an environment within the package that is sufficient to maintain the plastic balloon in a hydrated state.

According to a third aspect of the invention, a system for packaging a plastic balloon includes a substantially airtight package; and a plastic balloon contained within the package in a hydrated state.

According to a fourth aspect of the invention, a method of distributing a plastic balloon includes steps of hydrating the plastic balloon; and distributing the plastic balloon in the hydrated state.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
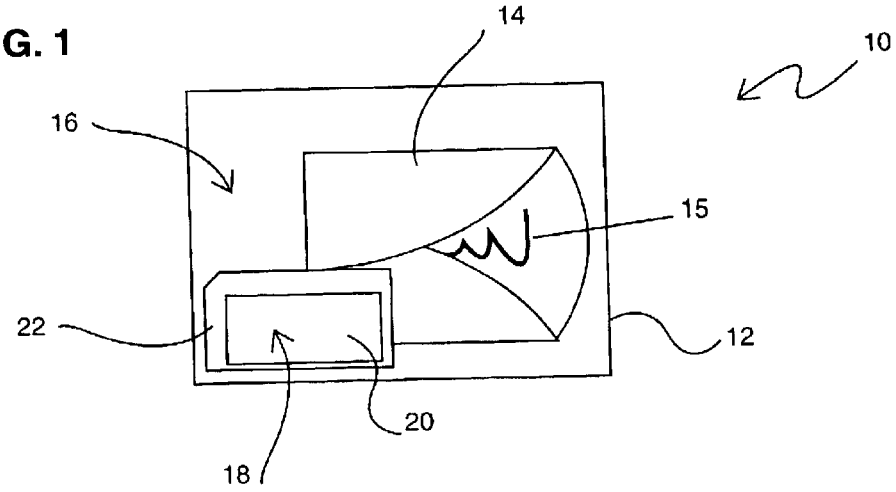
FIG. 1 is a first diagrammatical view depicting a system for packaging a plastic balloon according to be preferred embodiment of the invention.

Referring now to the drawings, wherein like reference numerals designate corresponding structure throughout the views, and referring in particular to FIG. 1, a system 10 for packaging a plastic balloon 14 includes a package 12 that in the preferred embodiment of the invention is constructed so as to be substantially airtight. By this, it is meant that the package 12 has a construction that is effective to prevent a significant amount of moisture from escaping from the package 12 before it is opened by a consumer. This may be accomplished by constructing the package 12 out of a plastic material, such as biaxially oriented polypropylene, that operates as a moisture barrier, with all edges being sealed to create an interior space that is hermetically isolated from the outside environment. For example, biaxially oriented polypropylene having a thickness of 20–40 microns may be used.

Plastic balloon 14, which is depicted in FIG. 1 as including a string 15, is positioned within the package 12. Preferably, plastic balloon 14 is fabricated from plastic sheet material that most preferably includes a first layer that is preferably fabricated of a biaxially oriented nylon 6, a second layer of Ethylene Vinyl Alcohol copolymer, a third layer of biaxially oriented nylon 6 and a fourth layer of linear low density polyethylene.

Figure 2:
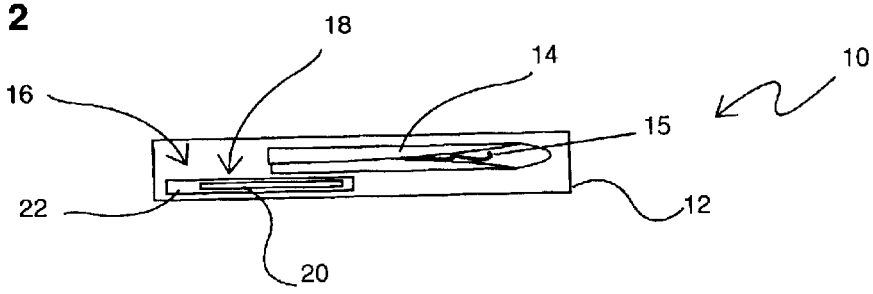
FIG. 2 is a second diagrammatical view depicting the system that is shown in FIG. 1.

According to one important aspect of the invention, hydration structure 16 is preferably provided for establishing an environment within the package 12 that is sufficient to maintain the plastic balloon 14 in a hydrated state. In the preferred embodiment of the invention, hydration structure 16 is embodied as moisturizing structure 18 that preferably includes a porous carrier element 20 that is at least partially saturated with an aqueous liquid. As shown in both FIGS. 1 and 2, the porous carrier element 20 may be positioned within a package 22 that keeps the porous carrier element 20 in a predetermined position within the package 12. Preferably, the hydration structure 16 is inserted into the package 12 at the facility where the plastic balloon 14 is manufactured, so that the plastic balloon 14 may be distributed to wholesalers and subsequently retailers and customers in a hydrated state.

In a preferred embodiment of the invention, porous carrier element 20 may be a basic paper hand towel that is saturated with an aqueous solution. Preferably, the aqueous solution is formulated so as to have both antifungal and antibacterial qualities, so as to inhibit the growth of molds and bacteria within the package 12. This may be accomplished by including in the composition of the aqueous solution both an antifungal agent and an antibacterial agent, or a substance that has both antifungal and antibacterial qualities. It is important that the substances used in the aqueous solution do not react chemically with the plastic sheet material of which the plastic balloon 14 is fabricated, or the material from which package 12 is fabricated. In the preferred embodiment, the aqueous solution contains water, calcium oxychloride, benzalkonium chloride, benzethonium chloride and a fragrance. Preferably, the benzalkonium chloride and benzethonium chloride are present within the solution at about seven percent by volume. Such a liquid is commercially available under the trade name AMOLDEN ID50 from Ideshigyo K. K. of Japan.

Preferably, the environment within the package 12 is preferably maintained so that a relative humidity of at least 50 percent is achieved and maintained. The plastic material of which the plastic balloon 14 is fabricated will, under uniform conditions, hold a maximum amount of water, which is defined as the condition of saturation. Preferably, the plastic balloon 14 is hydrated so as to contain enough water to be at least 15 percent saturated, and more preferably to be at least 20 percent saturated. Most preferably, the plastic balloon 14 is maintained in a state of hydration that is characterized by at least 50 percent saturation. For example, a simple 22 inch plastic balloon has been observed to have the capacity to absorb approximately 0.5 grams of moisture. Markedly improved performance of the plastic balloon has been observed with a hydration of only 0.1 grams of moisture.

In an alternative embodiment of the invention, the plastic balloon 14 may be prehydrated prior to being inserted into the package 12. The plastic balloon 14 will remain hydrated within the package 12 until the package 12 is opened because the package 12 is constructed so as to be sealed against moisture loss.

In yet another embodiment of the invention, the plastic balloon 14 may be sealed within the package 12, and moisture may be injected directly into the package 12 in a manner that reseals the package 12 against moisture loss.

One important advantage of the invention is that by keeping the plastic balloon 14 in a hydrated state, it will be assured that the consumer is provided with a plastic balloon 14 that will expand pliably upon inflation with a minimal risk of explosion. Such a hydrated plastic balloon 14 will float longer than a non-hydrated plastic balloon because when the balloon is stretched there is more space for helium. More helium, yet the same amount of balloon material weight will yield more float lime. In addition, a hydrated plastic balloon 14 will appear more attractive because it will have fewer wrinkles along the seams when inflated. In fact, a properly hydrated plastic balloon 14 can be inflated so as to be substantially wrinkle free. A balloon that is more attractive and floats for a longer period of time has a higher perceived value and can be sold for more, yet manufacturing costs only increase slightly due to the slightly increased cost of the packaging. However, the slightly increased cost will be more than offset by the obviation of the need for storing the plastic balloons in a humid environment throughout the distribution chain.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of packaging a plastic balloon, comprising:
(a) providing a plastic balloon;
(b) inserting the plastic balloon into a package; and
(c) establishing an environment within the package that is sufficient to maintain the balloon in a hydrated state.

2. A method of packaging a plastic balloon according to claim 1, wherein step (b) is performed by inserting the plastic balloon into a package that is substantially airtight, whereby loss of moisture from the package will be minimized.

3. A method of packaging a plastic balloon according to claim 1, wherein step (c) is performed by providing moisturizing means within the package for maintaining a humid atmosphere within the package.

4. A method of packaging a plastic balloon according to claim 1, wherein said moisturizing means comprises a porous carrier element that is at least partially saturated with an aqueous liquid.

5. A method of packaging a plastic balloon according to claim 4, wherein said aqueous liquid comprises an antifungal agent for inhibiting the growth of mold within the package.

6. A method of packaging a plastic balloon according to claim 4, wherein said aqueous liquid comprises an antibacterial agent for inhibiting the growth of bacteria within the package.

7. A method of packaging a plastic balloon according to claim 1, wherein step (c) is performed by hydrating the plastic balloon prior to packaging and maintaining an environment within the package that is sufficient to maintain such hydration.

8. A method of packaging a plastic balloon according to claim 7, wherein said step of maintaining an environment within the package that is sufficient to maintain the hydration is performed by maintaining the package in a substantially airtight condition.

9. A method of packaging a plastic balloon according to claim 1, wherein said hydrated state is characterized by said plastic balloon being maintained in a state of at least 15 percent saturation.

10. A method of packaging a plastic balloon according to claim 9, wherein said hydrated state is characterized by said plastic balloon being maintained in a state of at least 20 percent saturation.

11. A system for packaging a plastic balloon, comprising:
a package;
a plastic balloon contained within the package; and
hydration means for establishing an environment within the package that is sufficient to maintain the plastic balloon in a hydrated state.

12. A system for packaging a plastic balloon according to claim 11, wherein said package is substantially airtight.

13. A system for packaging a plastic balloon according to claim 11, wherein said hydration means comprises moisturizing means positioned within the package for maintaining a humid atmosphere within the package.

14. A system for packaging a plastic balloon according to claim 13, wherein said moisturizing means comprises a porous carrier element that is at least partially saturated with an aqueous liquid.

15. A system for packaging a plastic balloon according to claim 14, wherein said aqueous liquid comprises an antifungal agent for inhibiting the growth of mold within the package.

16. A system for packaging a plastic balloon according to claim 14, wherein said aqueous liquid comprises an antibacterial agent for inhibiting the growth of bacteria within the package.

17. A system for packaging a plastic balloon according to claim 11, further comprising antifungal means for inhibiting the growth of mold within the package.

18. A system for packaging a plastic balloon according to claim 11, further comprising antibacterial means for inhibiting the growth of bacteria within the package.

19. A system for packaging a plastic balloon according to claim 11, wherein said hydrated state is characterized by said plastic balloon being maintained in a state of at least 15 percent saturation.

20. A system for packaging a plastic balloon according to claim 19, wherein said hydrated state is characterized by said plastic balloon being maintained in a state of at least 20 percent saturation.

21. A system for packaging a plastic balloon, comprising:

a substantially airtight package; and a plastic balloon contained within the package in a hydrated state.

22. A system for packaging a plastic balloon according to claim 21, further comprising antifungal means provided within the package for inhibiting the growth of mold within the package.

23. A system for packaging a plastic balloon according to claim 21, further comprising antibacterial means provided within the package for inhibiting the growth of mold within the package.

24. A system for packaging a plastic balloon according to claim 21, wherein said hydrated state is characterized by said plastic balloon being maintained in a state of at least 15 percent saturation.

25. A system for packaging a plastic balloon according to claim 24, wherein said hydrated state is characterized by said plastic balloon being maintained in a state of at least 20 percent saturation.

26. A method of distributing a plastic balloon, comprising steps of:

(a) hydrating the plastic balloon; and (b) distributing the plastic balloon in the hydrated state.

27. A method of distributing a plastic balloon according to claim 26, wherein said step of hydrating the plastic balloon is performed at a manufacturing facility.

28. A method of distributing a plastic balloon according to claim 26, wherein said step of distributing the plastic balloon is performed by transporting the plastic balloon from a manufacturing facility to a wholesale facility.

29. A method of distributing a plastic balloon according to claim 26, wherein said step of distributing the plastic balloon is performed by transporting the plastic balloon to a retail facility.

30. A method of distributing a plastic balloon according to claim 29, wherein said hydrated state is characterized by said plastic balloon being maintained in a state of at least 15 percent saturation.

31. A method of packaging a plastic balloon according to claim 30, wherein said hydrated state is characterized by said plastic balloon being maintained in a state of at least 20 percent saturation.

* * * * *